US011661802B1

(12) United States Patent
Ramadhan

(10) Patent No.: US 11,661,802 B1
(45) Date of Patent: May 30, 2023

(54) CROSS BOP SWIVEL JOINT FOR STRING ROTATION DURING WELL CONTROL EVENTS

(71) Applicant: Saudi Arabian Oil Company, Dhahran (SA)

(72) Inventor: Ahmed Al Ramadhan, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/864,826

(22) Filed: Jul. 14, 2022

(51) Int. Cl.
*E21B 17/05* (2006.01)
*E21B 33/06* (2006.01)

(52) U.S. Cl.
CPC ..... *E21B 17/05* (2013.01); *E21B 33/06* (2013.01)

(58) Field of Classification Search
CPC ..... E21B 17/05; E21B 33/06
See application file for complete search history.

(56) References Cited

U.S. PATENT DOCUMENTS

| | | | | |
|---|---|---|---|---|
| 4,903,764 | A | 2/1990 | Gleditsch | |
| 7,007,753 | B2 * | 3/2006 | Robichaux | E21B 21/00 166/291 |
| 7,296,628 | B2 | 11/2007 | Robichaux et al. | |
| 7,413,023 | B2 * | 8/2008 | Howlett | E21B 33/076 166/387 |
| 10,273,763 | B2 | 4/2019 | Robichaux et al. | |
| 2006/0180312 | A1 | 8/2006 | Bracksieck et al. | |

* cited by examiner

*Primary Examiner* — Matthew R Buck
(74) *Attorney, Agent, or Firm* — Dinsmore & Shohl, LLP

(57) ABSTRACT

A cross BOP swivel joint for crossing over a blowout preventer of a drilling apparatus includes a swivel housing, an internal pipe received through the swivel housing. The internal pipe includes an upper loading shoulder and a lower loading shoulder. The cross BOP swivel joint includes an upper journal bearing, lower journal bearing, and at least one central bearing between the swivel housing and the internal pipe. The central bearings are axially disposed between the journal bearings. When engaged, the BOP contacts the outer surface of the swivel housing of the cross BOP swivel joint. The journal bearings allow the internal pipe to rotate relative to the swivel housing when the BOP is engaged with the swivel housing. This allows rotation of the drill string during well control events. The central bearing provides radial support to the swivel housing to reduce inward deflection of the swivel housing.

20 Claims, 5 Drawing Sheets

CROSS BOP SWIVEL JOINT FOR STRING ROTATION DURING WELL CONTROL EVENTS

BACKGROUND

Field

The present disclosure relates to natural resource well drilling and hydrocarbon production from subterranean formations, in particular, to cross BOP swivel joints for rotating drill strings during well control events.

Technical Background

Extracting hydrocarbons from subterranean sources often includes drilling a wellbore from the surface to the subterranean geological formation containing the hydrocarbons. The wellbore forms a pathway that permits both fluids and apparatus to traverse between the surface and the subterranean geologic formation. Besides defining the void volume of the wellbore, the wellbore wall also acts as the interface through which fluids can flow from the subterranean formations to the interior of the wellbore. Hydrocarbon producing wellbores extend subsurface and intersect various subterranean formations where hydrocarbons are trapped. The wellbore can contain at least a portion of a fluid conduit that links the interior of the wellbore to the surface. The fluid conduit connecting the interior of the wellbore to the surface can permit regulated fluid flow from the interior of the wellbore to the surface and allow for access between equipment on the surface and the interior of the wellbore.

Specialized drilling equipment, techniques, and materials are utilized to form the wellbore, complete the wellbore, and extract the hydrocarbons from hydrocarbon-bearing subterranean formations. The wellbore is initially formed by operating a drilling apparatus, which includes a drill bit coupled to the downhole end of a drill string, to bore into the earth to form the wellbore. A drive system at the surface rotates the drill string while drilling fluids are pumped downhole through the drill string. The drilling fluids flow into the wellbore through the drill bit and return to the surface through an annulus defined between the drill string and the wellbore wall. The drilling fluid convey cuttings uphole to the surface and provides hydrostatic pressure in the wellbore that maintains formation fluids in the formation until completion of the wellbore and commencement of hydrocarbon production, among other functions.

Imbalances between wellbore fluid pressure and formation pressure can result in fluids from the formation flowing into the wellbore and upwards through the annulus. These pressure imbalances that result in formation fluids flowing into the annulus of the wellbore is sometimes referred to as formation kick. The formation kick is considered a blowout when the formation fluids reach the surface. To control formation kick or respond to a blowout, modern drilling rigs include one or more blowout preventers (BOP), which are mechanical devices that seal the annulus between the wellbore wall and the outer surface of the drill string to prevent formation fluids from reaching the surface or to stop the flow of formation fluids out of the annulus at the surface. In response to formation kick, blowout, or other condition, the BOPs are engaged to shut in the wellbore until the pressure imbalance between the wellbore and the formation can be stabilized.

SUMMARY

During well control events, the BOPs are engaged to seal the annulus between the drill string and the wellbore wall.

Pipe ram BOPs and annular BOPs form a seal between the outer surface of the drill string and the wellbore wall, where the seal prevents the flow of fluids through the annulus back to the surface while allowing the flow of fluids into the wellbore through the drill string. Often, these BOPs engage directly with the outer surface of the drill string. The contact between the BOPs and the outer surface of the drill string and the pressure exerted by the BOPs on the outer surface of the drill string can prevent the drill string from being rotated during the well control event. An ongoing need exists for tools, such as cross BOP swivel joints that can enable rotation of the drill string during well control events.

The present disclosure is directed to cross BOP swivel joints that enable rotation of the drill string during well control events, such as when blowout preventers are engaged to shut in the wellbore. The cross BOP swivel joints of the present disclosure include a swivel housing, an internal pipe extending through the swivel housing, journal bearings radially disposed between the swivel housing and the internal pipe, and one or a plurality of central bearings axially disposed between the journal bearings and between the internal pipe and the swivel housing. The journal bearings and central bearings allow the internal pipe to efficiently rotate relative to the swivel housing. Both ends of the internal pipe are coupled to the drill string. The cross BOP swivel joint can enable rotation of the drill string relative to the wellbore during a well control event, during which a pipe-ram BOP, annular BOP, or both are actuated to engage with the swivel housing of the cross BOP swivel joint. The drill string can be rotated through rotation of the internal pipe relative to the swivel housing when the BOPs are engaged with the swivel housing. The central bearings can further provide radial support to the swivel housing to reduce or prevent deflection of the swivel housing radially inward due to the pressure exerted by a pipe ram BOP or annular BOP. Thus, the central bearings can prevent the deflection of the swivel housing from contacting the internal pipe and interfering with rotation of the internal pipe.

According to a first aspect of the present disclosure, a cross BOP swivel joint for crossing a blowout preventer (BOP) of a drilling apparatus can include a swivel housing comprising a hollow cylindrical wall having a top end, a bottom end, an inner surface that defines an inner cavity extending axially through the swivel housing, and an outer surface. The cross BOP swivel joint can further include an internal pipe received through the inner cavity of the swivel housing, where the internal pipe can comprise an upper loading shoulder proximate the top end of the swivel housing and a lower loading shoulder proximate the bottom end of the swivel housing. The cross BOP swivel joint can further include an upper journal bearing, a lower journal bearing, and at least one central bearing, each of which may be radially disposed between an outer surface of the internal pipe and the inner surface of the cylindrical wall of the swivel housing. The upper journal bearing may axially disposed between the upper loading shoulder of the internal pipe and the top end of the swivel housing. The lower journal bearing may be axially disposed between the lower loading shoulder of the internal pipe and the bottom end of the swivel housing. The upper journal bearing and the lower journal bearing may allow the internal pipe to rotate relative to the swivel housing. The at least one central bearing may be axially disposed between the upper journal bearing and the lower journal bearing. The outer surface of the swivel housing may contact the blowout preventer when the blowout preventer is engaged with the cross BOP swivel joint. The at least one central bearing may provide radial support to the swivel housing that reduces deformation of the swivel housing radially inward towards the internal pipe when the blowout preventer is engaged with the outer surface of the swivel housing.

A second aspect of the present disclosure may include the first aspect comprising a plurality of central bearings spaced apart from each other and distributed axially between the upper journal bearing and the lower journal bearing.

A third aspect of the present disclosure may include either one of the first or second aspects, where an axial center of the swivel housing may be a point that is axially disposed halfway between the upper journal bearing and the lower journal bearing. The at least one central bearing may be axially positioned at a distance from the axial center of the swivel housing that is less than 40% of an axial length between the upper journal bearing and the lower journal bearing.

A fourth aspect of the present disclosure may include the third aspect, comprising a plurality of central bearings, where each of the plurality of central bearings may be axially positioned at a distance from the axial center of the swivel housing that is less than 40% of the axial length between the upper journal bearing and the lower journal bearing.

A fifth aspect of the present disclosure may include the fourth aspect, where the plurality of central bearings may be spaced apart and evenly distributed axially between the upper journal bearing and the lower journal bearing.

A sixth aspect of the present disclosure may include any one of the first through fifth aspects, where the at least one central bearing can comprise at least one ball bearing.

A seventh aspect of the present disclosure may include the sixth aspect, where the at least one ball bearing may comprises an outer race secured to the inner surface of the swivel housing, an inner race secured to the outer surface of the internal pipe, and a plurality of rigid balls disposed between the inner race and the outer race, where the at least one ball bearing stabilizes rotation of the internal pipe relative to the swivel housing and reduces deformation of the swivel housing radially inward towards the internal pipe when a blowout preventer is engaged with the outer surface of the swivel housing.

An eighth aspect of the present disclosure may include any one of the first through seventh aspects, where the upper journal bearing and the lower journal bearing may be rigidly coupled to the swivel housing and slidably engaged with the internal pipe to allow the internal pipe to rotate relative to the journal bearing and swivel housing.

A ninth aspect of the present disclosure may include any one of the first through eighth aspects, further comprising a plurality of seals disposed radially between an outer surface of the internal pipe and an inner surface of the cylindrical wall of the swivel housing. The seals may restrict fluid flow through an annular gap between the internal pipe and the inner surface of the cylindrical wall of the swivel housing.

A tenth aspect of the present disclosure may include the ninth aspect, where the plurality of seals may comprise a plurality of upper seals disposed axially between the upper journal bearing and the top end of the swivel housing and a plurality of lower seals disposed axially between the lower journal bearing and the bottom end of the swivel housing.

An eleventh aspect of the present disclosure may include either one of the ninth or tenth aspects, where the plurality of seals may comprise a plurality of internal seals disposed axially between the at least one central bearing and the upper journal bearing and between the at least one central bearing and the lower journal bearing.

A twelfth aspect of the present disclosure may include any one of the ninth through eleventh aspects, where an annular compartment may be defined radially between the inner surface of the swivel housing and the outer surface of the internal pipe, one or more internal seals may be radially disposed in the annular compartment, and the one or more internal seals fluidly may separate the annular compartment into a plurality of annular compartments.

A thirteenth aspect of the present disclosure may include the twelfth aspect, further comprising a lubricant disposed in the plurality of annular compartments.

A fourteenth aspect of the present disclosure may include either one of the twelfth or thirteenth aspects, further comprising at least one port in the swivel housing, wherein the at least one port may extend radially through the swivel housing and the at least one port may be in fluid communication with an annular compartment.

A fifteenth aspect of the present disclosure may include any one of the first through fourteenth aspects, where the internal pipe may extend axially above the top end and below the bottom end of the swivel housing.

A sixteenth aspect of the present disclosure may include fifteenth aspect, where the internal pipe may further comprise a box connection at an upper end of the drill pipe and a pin connection at a lower end of the drill pipe.

A seventeenth aspect of the present disclosure may include any one of the first through sixteenth aspects and may be directed to a drilling apparatus comprising at least one blowout preventer, the cross BOP swivel joint of any one of the first through sixteenth aspects, and a drill string coupled to a lower end of the internal pipe of the cross BOP swivel joint. The cross BOP swivel joint may be received through an opening in the at least one blowout preventer, and when the at least one blowout preventer is activated, the at least one blowout preventer may contact an outer surface of the swivel housing of the cross BOP swivel joint.

An eighteenth aspect of the present disclosure may include the seventeenth aspect, further comprising a drive system coupled to an upper end of the internal pipe of the cross BOP swivel joint. The drive system may be operable to rotate the drill string through the internal pipe connecting the drive system to the drill string, where the drill string may be rotated relative to the wellbore.

A nineteenth aspect of the present disclosure may include either one of the seventeenth or eighteenth aspects, where the at least one blowout preventer may be a pipe ram blowout preventer, an annular blowout preventer, of a combination of both.

A twentieth aspect of the present disclosure may include any one of the first through sixteenth aspects, and may be directed to a method of drilling a subterranean formation. The method may include operating a drill string in a wellbore, the drill string comprising the cross BOP swivel joint of any one of the first through sixteenth aspects. The method can further include sealing an annulus between the drill string and a wellbore wall of the wellbore by operating at least one blowout preventer disposed at a surface of the wellbore. The blowout preventer may engage with an outer surface of the swivel housing of the cross BOP swivel joint. The method may further include after sealing the annulus with the at least one blowout preventer, rotating the drill string in the wellbore. Engagement of the blowout preventer with the outer surface of the swivel housing may maintain the swivel housing in a static position. Rotating the drill string may cause the internal pipe of the cross BOP swivel joint to rotate relative to the swivel housing. The at least one central bearing may reduce deflection of the swivel housing radially inward towards the internal pipe.

A twenty-first aspect of the present disclosure may include the twentieth aspect, further comprising identifying a condition of the wellbore indicative of a wellbore kick, and in response to the condition indicative of the wellbore kick, operating the at least one blowout preventer to seal the annulus.

Additional features and advantages of the technology described in this disclosure will be set forth in the detailed description that follows, and in part will be readily apparent to those skilled in the art from the description or recognized by practicing the technology as described in this disclosure, including the detailed description that follows, the claims, as well as the appended drawings.

BRIEF DESCRIPTION OF THE DRAWINGS

The following detailed description of specific embodiments of the present disclosure can be best understood when read in conjunction with the following drawings, where like structure is indicated with like reference numerals and in which.

Reference will now be made in greater detail to various embodiments of the present disclosure, some embodiments of which are illustrated in the accompanying drawings. Whenever possible, the same reference numerals will be used throughout the drawings to refer to the same or similar parts.

DETAILED DESCRIPTION

Figure 5:
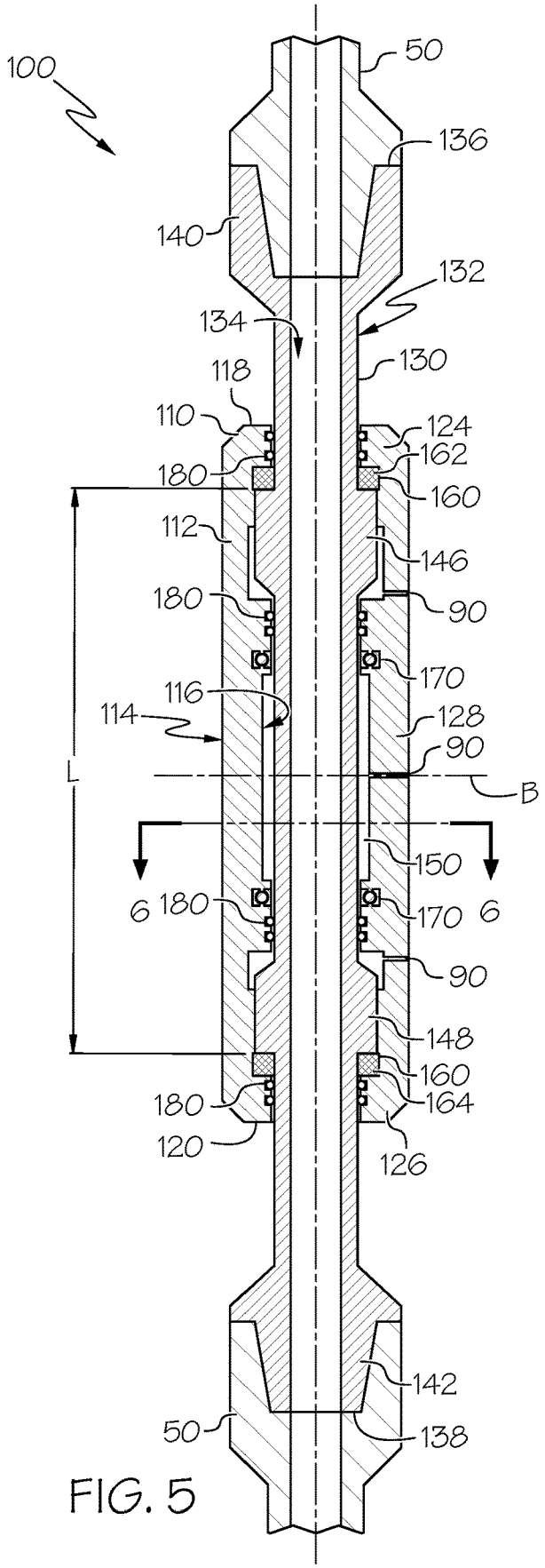
FIG. 5 schematically depicts a front cross-sectional view of a cross BOP swivel joint, according to one or more embodiments shown and described in this disclosure.

The present disclosure is directed to a cross BOP swivel joint for a drilling apparatus for drilling a wellbore through a subterranean formation. Referring to FIG. 5, one embodiment of the cross BOP swivel joint 100 of the present disclosure for crossing a blowout preventer (BOP) of a drilling apparatus is schematically depicted. The cross BOP swivel joint 100 comprises a swivel housing 110 and an internal pipe 130 received through the swivel housing 110. The swivel housing 110 can comprise a hollow cylindrical wall 112 having a top end 120, a bottom end 122, an outer surface 114, an inner surface 116 that defines an inner cavity 118 extending axially through the swivel housing 110. The internal pipe 130 can be received through the inner cavity 118 of the swivel housing 110 and can include an upper loading shoulder 146 proximate the top end 120 of the swivel housing 110 and a lower loading shoulder 148 proximate the bottom end 122 of the swivel housing 110. The cross BOP swivel joint 100 can include an upper journal bearing 162, a lower journal bearing 164, and at least one central bearing 170, each of which is radially disposed between an outer surface 132 of the internal pipe 130 and the inner surface 116 of the cylindrical wall 112 of the swivel housing 110. The upper journal bearing 162 can be axially disposed between the upper loading shoulder 146 of the internal pipe 130 and the top end 120 of the swivel housing 110, and the lower journal bearing 164 can be axially disposed between the lower loading shoulder 148 of the internal pipe 130 and the bottom end 122 of the swivel housing 110. The upper journal bearing 162 and the lower journal bearing 164 allow the internal pipe 130 to rotate relative to the swivel housing 110. The at least one central bearing 170 can be axially disposed between the upper journal bearing 162 and the lower journal bearing 164. The outer surface 114 of the swivel housing 110 contacts the BOP when the BOP is engaged with the cross BOP swivel joint 100. The central bearing 170 provides radial support to the swivel housing 110 that can reduce deformation of the swivel housing 110 radially inward towards the internal pipe 130 when the BOP is engaged with the outer surface 114 of the swivel housing 110.

As used throughout the present disclosure, the term "hydrocarbon-bearing formation" refers to a subterranean geologic region containing hydrocarbons, such as crude oil, hydrocarbon gases, or both, which may be extracted from the subterranean geologic region. The terms "subterranean formation" or just "formation" refer to a subterranean geologic region that contains hydrocarbons or a subterranean geologic region proximate to a hydrocarbon-bearing formation, such as a subterranean geologic region to be treated for purposes of enhanced oil recovery or reduction of water production or a subterranean geologic region that must be drilled through to get to the hydrocarbon-bearing formation.

As used in the present disclosure, the term "uphole" refers to a direction in a wellbore that is towards the surface. For example, a first component that is uphole relative to a second component is positioned closer to the surface of the wellbore relative to the second component.

As used in the present disclosure, the term "downhole" refers to a direction further into the formation and away from the surface. For example, a first component that is downhole relative to a second component is positioned farther away from the surface of the wellbore relative to the second component. The terms "uphole" and "downhole" are not intended to imply a vertical arrangement but rather are directions along a center axis of the wellbore relative to the surface.

As used throughout the present disclosure, the term "fluid" includes liquids, gases, or both and can include solids in combination with the liquids, gases, or both, such as but not limited to suspended solids in the wellbore fluids; entrained particles in gas produced from the wellbore; drilling fluids comprising weighting agents, lost circulation materials, cuttings, or other solids; or other mixed phase suspensions, slurries and other fluids.

As used in the present disclosure, a fluid passing from a first feature "directly" to a second feature refers to the fluid passing from the first feature to the second feature without passing or contacting a third feature intervening between the first and second feature.

As used throughout the present disclosure, the term "axial" refers to a direction in parallel to the central axis A of the cross BOP swivel joint and drill string. As used throughout the present disclosure, term "radial" refers to a direction that is perpendicular to and outward from the central axis A of the cross BOP swivel joint and drill string. As used throughout the present disclosure, the term "angular" refers to an angular position of a structure about the central axis A of the cross BOP swivel joint.

As used throughout the present disclosure, the term "well control event" refers to closure of the annulus of the wellbore, which is defined between the drill string and the wellbore wall or tubular casing, to prevent fluid flow from the annulus to the surface in response to wellbore conditions indicative of formation kick or blowout.

Figure 1:
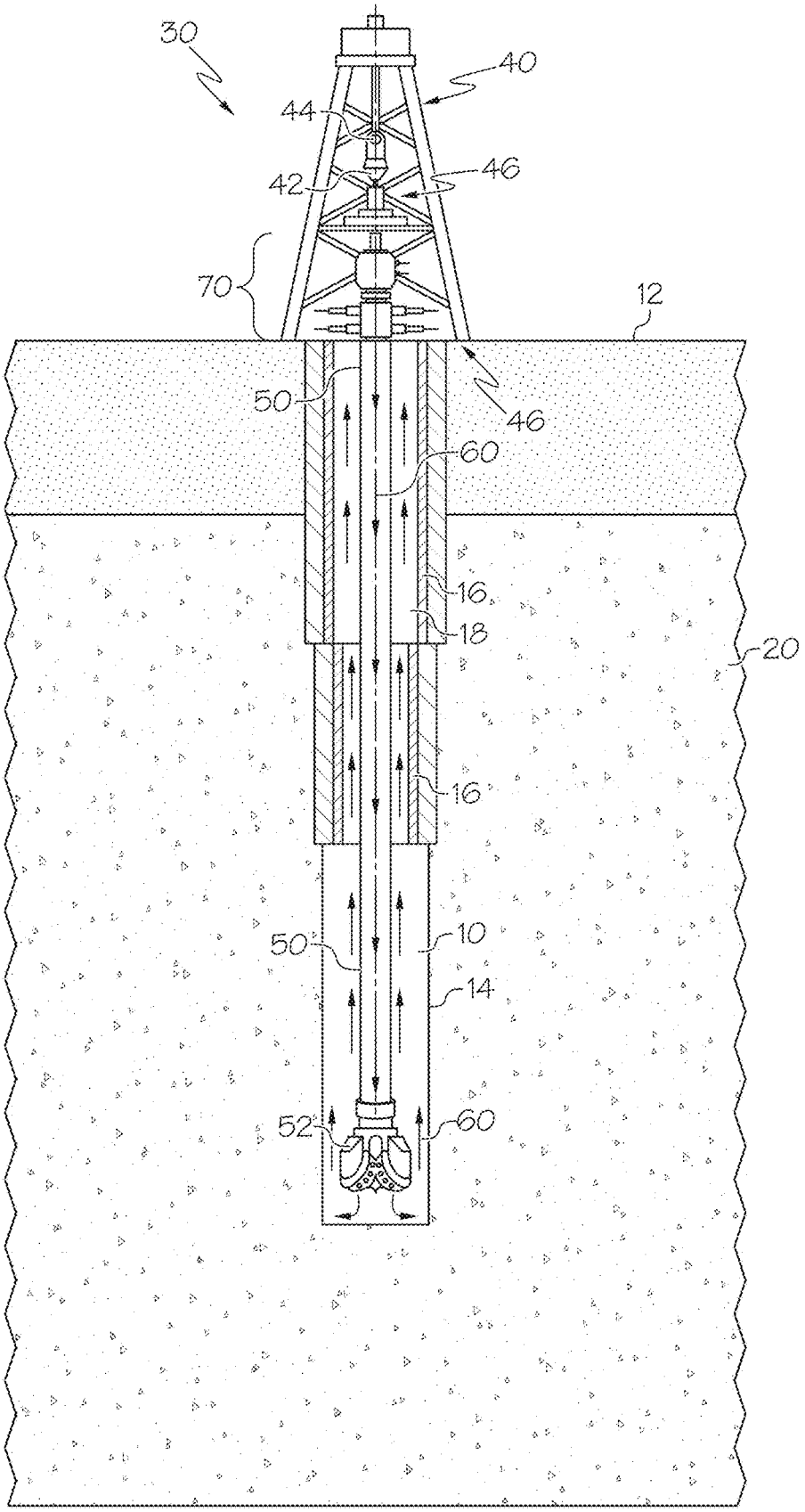
FIG. 1 schematically depicts a drilling apparatus comprising at least a drilling rig and a drill string comprising a drill bit for drilling a wellbore through a subterranean formation, according to one or more embodiments shown and described in this disclosure.

Referring now to FIG. 1, a wellbore 10 extending from the surface 12 into a subterranean formation 20 is schematically depicted. The wellbore 10 forms a pathway capable of permitting both fluids and apparatus to traverse between the surface 12 and the subterranean formation 20, such as a hydrocarbon-bearing subterranean formation. Besides defining the void volume of the wellbore 10, the wellbore wall 14 also acts as an interface through which fluid can transition between the subterranean formation 20 and the interior of the wellbore 10. The wellbore wall 14 can be unlined (that is, bare rock or formation) to permit such interaction with the formation or lined, such as by a tubular casing 16, to prevent such interactions.

The wellbore 10 provides a fluid conduit that links the interior of the wellbore 10 to the surface 12. The fluid conduit connecting the interior of the wellbore 10 to the surface 12 can permit regulated fluid flow from the interior of the wellbore 10 to the surface 12 and access between equipment on the surface 12 and the interior of the wellbore 10. Examples of equipment connected at the surface 12 to the fluid conduit can include but are not limited to pipelines, tanks, pumps, compressors, flares, or combinations of these. The fluid conduit may be large enough to permit introduction and removal of mechanical devices, including but not limited to tools, drill strings, sensors, instruments, or combinations of these into and out of the interior of the wellbore 10.

Referring again to FIG. 1, a drilling apparatus 30 for drilling the wellbore 10 is schematically depicted. The drilling apparatus 30 can include, a drilling rig 40, a drill string 50 operatively coupled to the drilling rig 40 and extending downhole into the wellbore 10, and a drill bit 52 coupled to a downhole end of the drill string 50. The drilling rig 40 is used in the present disclosure to refer to the part of the drilling apparatus 30 disposed at the surface 12. The drilling apparatus 30 further includes a blowout preventer (BOP) stack 70. The drill string 50 with the drill bit 52 is disposed downhole, and the drilling rig 40 operates to rotate the drill string 50, thereby rotating the drill bit 52. The drill string 50 generally includes a plurality of interconnected drill pipes extending from the surface 12 down into the wellbore 10 to the drill bit 52. The drill string 50 has a center axis A. In the present disclosure, the axial direction refers to movement of components in an uphole or downhole direction parallel to the center axis A of the drill string 50. The radial direction refers to a direction perpendicular to and outward from the center axis A of the drill string 50. During certain stages in the life cycle of the wellbore, the drill string 50 can be replaced with one or more of a cement string, production tubing, injection tubing, or other equipment in the drilling apparatus 30.

Rotation of the drill string 50 in the wellbore 10 and axial movement of the drill string 50 in the uphole and downhole directions during drilling is controlled by the drilling rig 40 disposed at the surface 12 of the wellbore 10. The drilling rig 40 can include a swivel 42 coupled to the uphole end of the drill string 50, a hoist system 44, and a drive system 46. The swivel 42 may be rigidly secured to an uphole end of the drill string 50. The other end of the swivel 42 may be coupled to the hoist system 44. The swivel 42, which is different from the cross BOP swivel joint 100 of the present disclosure, may be operable to allow the drill string 50 to be rotated relative to the hoist system 44. The hoist system 44 is coupled to the swivel 42 on the end of the swivel 42 opposite the drill string 50. The hoist system 44 is operable to raise and lower the drill string 50 to translate the drill string 50 axially through the wellbore 10 in the uphole or downhole directions, respectively. The drive system 46 is operable to rotate the drill string 50 relative to the wellbore 10. The drive system 46 can be a Kelly drive, a top drive, or other drive system.

Rotation of the drill string 50 in combination with the weight of the drill string 50 causes the drill bit 52 to bore into the bottom or downhole end of the wellbore 10 to extend the depth of the wellbore 10 into the subterranean formation 20. While drilling, a drilling fluid 60 is typically circulated through the drill string 50 and the drill bit 52. During operation of the drill bit 52, the drilling fluid 60 is pumped through the inner conduit defined by the interconnected drill pipe of the drill string 50 to the drill bit 52. The drilling fluids 60 flow from the drill string 50, through the drill bit 52, and out into the wellbore 10. The drilling fluids 60 then flow back uphole through the wellbore 10 to the surface 12. In particular, the drilling fluids 60 flow uphole through the annulus 18 defined between the wellbore wall 14 of the wellbore 10 and an outer surface of the drill string 50.

Drilling fluids 60 are formulated to have rheological properties that enable the drilling fluids 60 to convey cuttings from the drill bit 52 at the downhole end of the wellbore 10 uphole to the surface 12. Additionally, the drilling fluids 60 are formulated to provide hydrostatic forces within the wellbore 10 to support the wellbore wall 14 and provide resistance to the flow of formation fluids, such as hydrocarbon liquids, hydrocarbon gases, water, formation treatment fluids, or other fluids, from the subterranean formation 20 into the wellbore 10. In particular, the drilling fluids 60 provide a hydrostatic force that is greater than or equal to the pressure of fluids in the subterranean formation 20 so that the hydrostatic force of the drilling fluid 60 resists flow of formation fluids into the wellbore 10. This keeps the formation fluids in the subterranean formation 20 until the wellbore is completed and ready for production or injection.

Under certain conditions, the hydrostatic forces of the drilling fluid 60 and the pressure of the formation fluids become unbalanced. As previously discussed, imbalances between hydrostatic pressure of the drilling fluid 60 and formation pressure can result in formation fluids flowing from the subterranean formation, into the wellbore 10, and upwards through the annulus 18 towards the surface 12.

These pressure imbalances that result in formation fluids flowing into the wellbore 10 is referred to as formation kick. The formation kick becomes a blowout when the formation fluids reach the surface 12.

To control formation kick or respond to a blowout, the drilling apparatus 30 includes the BOP stack 70, which is secured to the wellbore 10 at the junction of the wellbore 10 with the surface 12. The BOP stack 70 includes one or a plurality of BOPs, which can include ram-type BOPs, annular BOPs, shear BOPs, blind BOPs, other types of BOPs, or combinations of these. The drill string 50 passes through the center of the BOP stack 70 and into the wellbore 10. The BOPs of the BOP stack 70 are mechanical devices that seal the annulus 18 between the wellbore wall 14 and the outer surface of the drill string 50 to prevent formation fluids from reaching the surface 12 in the event of formation kick or to stop the flow of formation fluids out of the annulus 18 at the surface 12 during a blowout. During a well control event, such as formation kick or blowout, one or more of the BOPs in the BOP stack 70 are actuated to close the annulus 18 until the well control issue is remediated.

Figure 2:
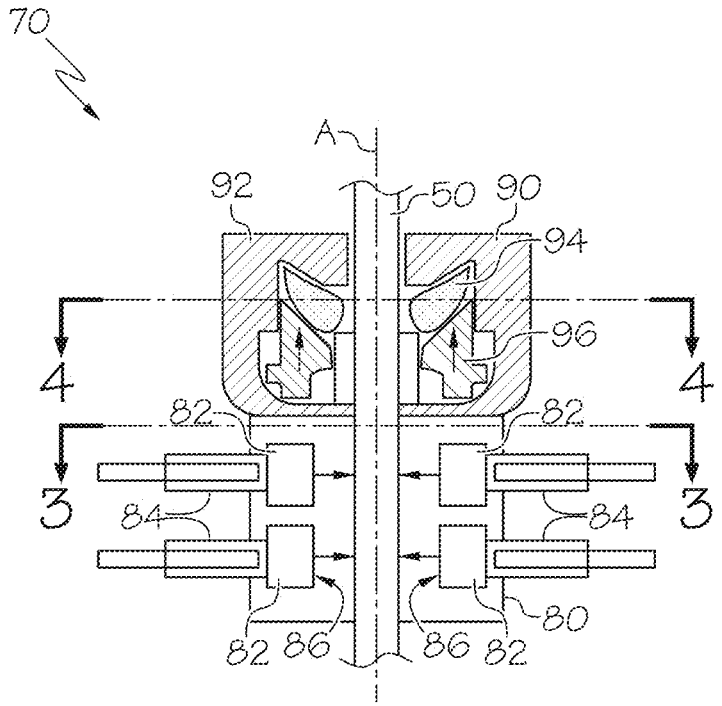
FIG. 2 schematically depicts a front cross-sectional view of a blowout preventer stack of the drilling apparatus of FIG. 1, according to one or more embodiments shown and described in this disclosure.
Figure 3:
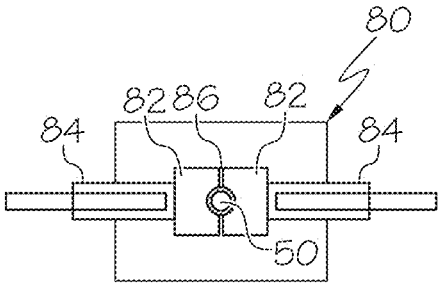
FIG. 3 schematically depicts a top view of a pipe ram blowout preventer in a closed position, according to one or more embodiments shown and described in this disclosure.

Referring now to FIG. 2, in embodiments, the BOP stack 70 can include one or more pipe-ram BOPs 80, one or more annular BOPs 90, or a combination of these. The pipe-ram BOP 80 can include two opposing rams 82 and two actuators 84 that operate to move each of the opposing rams 82 into and out of an engagement position. Referring to FIGS. 2 and 3, each of the rams 82 of the pipe-ram BOP 80 comprise an engagement surface 86 having a semi-cylindrical surface that is shaped to engage with the outer surface of the drill string 50 when the rams 82 are pressed together by the actuators 84. The actuators 84 can be hydraulic cylinders or other actuating devices operable to move the rams 82 along a linear path between the engaged position and the disengaged position.

Referring to FIG. 3, in the engaged position, the rams 82 of the pipe-ram BOP 80 are moved toward each other until the rams 82 contact each other and contact the outer surface of the drill string 50. In the engaged position, the pipe-ram BOP 80 closes off the annular space between the drill string 50 and the wellbore wall 14 to prevent fluid flow from the annulus 18 to the surface 12 while allowing fluid flow through center of the drill string 50. The pipe-ram BOP 80 can have a resilient material on the engagement surfaces 86 of the rams 82, the resilient material providing a seal around the outer surface of the drill string 50 when the pipe-ram BOP 80 is in the engaged position. The actuators 84 can also operate to move the rams 82 out of the engaged position to a disengaged positon to reopen the annulus 18, such as to reopen the annulus 18 to resume drilling operations once the well control event is corrected.

Referring again to FIG. 2, in embodiments, the BOP stack 70 can include an annular BOP 90. In embodiments, an annular BOP 90 can comprise a housing 92, a sealing member 94, and a piston 96. The drill string 50 passes through the axial center of the annular BOP 90. The sealing member 94 is disposed within the housing 92. The sealing member 94 can be an elastomeric ring. The piston 96 can be actuated to reduce the volume of an internal chamber of the annular BOP 90 and deform or squeeze the sealing member 94 into engagement with the outer surface of the drill string 50. In the engagement position, the sealing member 94 is squeezed or forced into contact with the outer surface of the drill string 50 to seal the annulus 18 between the drill string 50 and the wellbore wall 14. The annular BOP 90 can be opened by moving the piston 96 back into the original position to open up the internal cavity within the annular BOP 90 and relieve the pressure on the sealing member 94 against the outer surface of the drill string 50.

Figure 4:
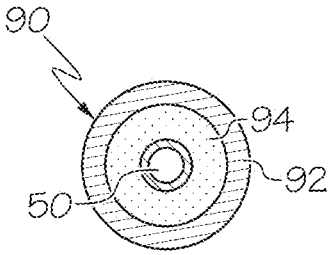
FIG. 4 schematically depicts a top cross-sectional view of an annular blowout preventer in a closed position, according to one or more embodiments shown and described in this disclosure.

Referring now to FIGS. 3 and 4, for the pipe-ram BOP 80 and the annular BOP 90, engagement of the BOP results in contact between a portion of the BOP (ram 82 of the pipe-ram BOP 80, sealing member 94 of the annular BOP 90) and the outer surface of the drill string 50 that can restrict or prohibit rotation of the drill string 50 during a well control event or well shut-in. As a result, generally the drill string 50 cannot be rotated during a well control even or well shut-in. The inability to rotate the drill string 50 can result in differential sticking of the drill string 50 in the wellbore 10. Differential sticking is caused by having high hydrostatic overbalance of the pressure of the wellbore fluids against the pore pressure of the subterranean formation 20, which can push the drill sting 50 against the wellbore wall 14 and prevent pipe movement. High hydrostatic overbalance can occur when remediating the well control event. Differential sticking of the drill string 50 in the wellbore 10 requires expensive and lengthy fishing operations to release the stuck drill string 50. In many cases, the drill string 50 and bottom hole assembly (BHA) (drill bit, under reamer, drill collar, and other associated equipment) cannot be recovered by fishing and the wellbore 10 has to be abandoned to sidetrack the well into a new direction. Being able to continuously rotate the drill string 50 during well control events and well shut-in can reduce or prevent differential sticking of the drill string 50. Thus, ongoing needs exist for cross BOP swivel joints for enabling efficient rotation of the drill string 50 during well control events or well shut-in.

The present disclosure is directed to a cross BOP swivel joint for crossing the BOP stack 70 and enabling efficient and unrestricted rotation of the drill string 50 during well control events or well shut-in when the BOPs are engaged to seal off the annulus. Enabling efficient and unrestricted rotation of the drill string 50 in the wellbore 10 when the BOPs are activated can prevent extended stationary time of drill string 50 and drill BHA across the open hole and allow continuous rotation during well control events, well shut-in and killing operations. Enabling efficient and unrestricted rotation of the drill string 50 during well control events can reduce or prevent differential sticking of the drill string 50 and BHA against the porous permeable subterranean formation. Once the well is put back under control with proper kill mud in the wellbore 10, the BOPs can be opened and the drill string 50 can be free to rotate to resume drilling operations.

Referring now to FIG. 5, the cross BOP swivel joint 100 of the present disclosure can include a swivel housing 110, an internal pipe 130 received axially through the swivel housing 110, journal bearings 160 disposed radially between the swivel housing 110 and the internal pipe 130 and disposed axially proximate to each end of the swivel housing 110, and at least one central bearing 170 axially disposed between the journal bearings 160. The swivel housing 110 provides an outer surface 114 that engages with the BOPs when engaged. The internal pipe 130 is secured at both ends to the drill string 50 or other equipment, such as but not limited to a cement string, production tubing, injection tubing, drive system, or combinations of these. The cross BOP swivel joint 100 can further include a plurality of seals 180 disposed radially between the swivel housing 110 and the internal pipe 130. The cross BOP swivel joint 100 can further include one or a plurality of ports 190 in the swivel housing 110.

The journal bearings 160 and the at least one central bearing 170 allow the internal pipe 130 to rotate relative to the swivel housing 110 when the BOPs are actuated during a well control event. Thus, when engagement of the pipe ram BOP, annular BOP, or both with the outer surface 114 of the swivel housing 110 restricts or inhibits rotation of the swivel housing 110, the internal pipe 130 and drill string 50, which is secured to the internal pipe 130, can still rotate relative to the swivel housing 110. In some cases, the pressure of the pipe ram BOPS, annular BOPs, or both on the outer surface 114 of the swivel housing 110 can deflect the swivel housing 110 radially inward, which can cause the swivel housing 110 to contact and interfere with rotation of the internal pipe 130. The central bearing(s) 170 of the cross BOP swivel joint 100 can provide radial support to the swivel housing 110 to reduce or prevent the pipe ram BOP or annular BOP from deflecting the swivel housing 110 radially inward and interfering with rotation of the internal pipe 130, thus, maintaining efficient rotation of the internal pipe 130 relative to the swivel housing 110. Additionally, the central bearing(s) 170 can further stabilize rotation of the internal pipe 130 by providing an additional bearing disposed between the two journal bearings 160, which provides an additional contact point.

Figure 6:
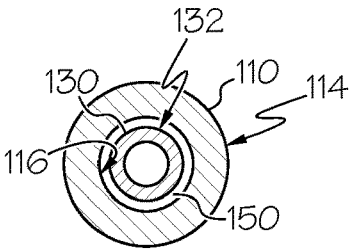
FIG. 6 schematically depicts a top cross-sectional view of the cross BOP swivel joint of FIG. 5, where the cross-section is taken along reference line 6-6 in FIG. 5, according to one or more embodiments shown and described in this disclosure.

Referring again to FIG. 5, the swivel housing 110 can include a hollow cylindrical wall 112 having the outer surface 114 and an inner surface 116. The inner surface 116 defines an inner cavity 118 extending axially through the swivel housing 110. In embodiments, the inner cavity 118 may be centered on the center axis A of the drill string 50. The swivel housing 110 has a top end 120 and a bottom end 122, where the top end 120 is the end oriented in the uphole direction towards to the drilling rig 40 and the bottom end 122 is the end of the swivel housing 110 oriented in the downhole direction towards the wellbore 10. The outer surface 114 of the swivel housing 110 may have a shape that compliments a shape of the engagement surface 86 (FIG. 3) of the pipe-ram BOP 80. Referring to FIG. 6, in embodiments, the outer surface 114 of the swivel housing 110 can have a circular cross-sectional shape.

Referring again to FIG. 5, the inner surface 116 of the swivel housing 110 can include an upper restriction 124 proximate to the top end 120 of the swivel housing 110, a lower restriction 126 proximate the bottom end 122 of the swivel housing 110, and a central wall 128 extending axially between the upper restriction 124 and the lower restriction 126. The upper restriction 124 and lower restriction 126 can comprises portions of the cylindrical wall 112 where the inner surface 116 has an inner diameter that is less than the inner diameter of the central wall 128. At the upper restriction 124 and the lower restriction 126, the inner surface 116 of the swivel housing 110 is radially disposed close to an outer surface 132 of the internal pipe 130 to create a restriction to reduce fluid flow between the swivel housing 110 and the internal pipe 130 at the top end 120 and the bottom end 122 of the swivel housing 110. The central wall 128 is radially spaced apart from the internal pipe 130 so that the inner surface 116 of the swivel housing 110 and the outer surface 132 of the internal pipe 130 define at least one annular compartment 150 disposed radially between the swivel housing 110 and the internal pipe 130. The annular compartment 150 may provide the radial clearance to accommodate the journal bearings 160 and central bearings 170 disposed between the internal pipe 130 and the swivel housing 110.

Referring again to FIG. 5, the cross BOP swivel joint 100 comprises the internal pipe 130 extending axially through the inner cavity 118 of the swivel housing 110. The internal pipe 130 comprises an outer surface 132 facing radially outward towards the inner surface 116 of the swivel housing 110. The outer surface 132 of the internal pipe 130 may have a cross sectional shape that is circular, particularly in places where the outer surface 132 engages with the journal bearings 160 and the central bearings 170. In embodiments, the internal pipe 130 may be centered on the center axis A of the drill string 50 so that the internal pipe 130 is coaxial with the swivel housing 110. The internal pipe 130 can further include an internal conduit 134 that extends axially through the internal pipe 130. The internal conduit 134 provides a fluid pathway through the cross BOP swivel joint 100 for passing materials and/or instruments axially through the cross BOP swivel joint 100 between the wellbore 10 and the surface 12.

When assembled, the swivel housing 110 surrounds at least a portion of the internal pipe 130. The internal pipe 130 can extend axially beyond the top end 120 and the bottom end 122 of the swivel housing 110. The internal pipe 130 can further include an upper end 136 and a lower end 138. The upper end 136 of the internal pipe 130 may be disposed vertically above the top end 120 of the swivel housing 110, such as uphole relative to the top end 120 of the swivel housing 110. The lower end 138 of the internal pipe 130 may be disposed vertically below the bottom end 122 of the swivel housing 110, such as downhole relative to the bottom end 122 of the swivel housing 110. The internal pipe 130 can include connections at the upper end 136 and lower end 138, where the connections can operate to rigidly secure the internal pipe 130 to the drill string 50 at each end of the internal pipe 130. In embodiments, the internal pipe 130 can include a box connection 140 at the upper end 136 and a pin connection 142 at the lower end 138 of the internal pipe 130. The upper end 136 and lower end 138 of the internal pipe 130 can each have any other suitable type of connection operable to rigidly secure the internal pipe 130 to the drill string 50. The connections, such as box connection 140 and pin connection 142, can also couple the internal pipe 130 to other structures, such as a cement string, a Kelly of a Kelly drive system, the swivel 42, production tubing, injection tubing, or other equipment useful for drilling the wellbore 10, completing the wellbore 10, producing hydrocarbons from the wellbore 10, injecting treatment fluids into the subterranean formation from the wellbore 10, or closing a wellbore 10.

Referring again to FIG. 5, the internal pipe 130 can further include an upper loading shoulder 146 disposed axially proximate the upper restriction 124 of the swivel housing 110 and a lower loading shoulder 148 disposed axially proximate the lower restriction 126 of the swivel housing 110. The upper loading shoulder 146 and the lower loading shoulder 148 may extend radially outward from the internal pipe 130. The upper loading shoulder 146 and the lower loading shoulder 148 may include abutment surfaces that can restrict axial travel of the internal pipe 130 relative to the swivel housing 110. The abutment surfaces of the upper loading shoulder 146 and the lower loading shoulder 148 may abut against the journal bearings 160 or the upper restriction 124 or lower restriction 126 of the swivel housing 110 to restrict axial movement of the internal pipe 130 relative to the swivel housing 110.

Referring again to FIG. 5, the cross BOP swivel joint 100 comprises two journal bearings 160 that facilitate rotation of the internal pipe 130 relative to the swivel housing 110. The journal bearings 160 can comprise an upper journal bearing 162 and a lower journal bearing 164. The upper journal bearing 162 and the lower journal bearing 164 are radially disposed between the inner surface 116 of the swivel housing 110 and the outer surface 132 of the internal pipe 130. The journal bearings 160 can be any type of journal bearing operable to enable rotation of the internal pipe 130 relative to the swivel housing 110.

The upper journal bearing 162 may be axially disposed proximate to the top end 120 of the swivel housing 110, such as between the upper loading shoulder 146 of the internal pipe 130 and the top end 120 of the swivel housing 110. In embodiments, the upper journal bearing 162 may be axially disposed within the annular compartment 150 between the upper loading shoulder 146 of the internal pipe 130 and the upper restriction 124 of the swivel housing 110. The lower journal bearing 164 may be axially disposed proximate to the bottom end 122 of the swivel housing 110, such as between the lower loading shoulder 148 of the internal pipe 130 and the bottom end 122 of the swivel housing 110. In embodiments, the lower journal bearing 164 may be axially disposed within the annular compartment 150 between the lower loading shoulder 148 of the internal pipe 130 and the lower restriction 126 of the swivel housing 110.

The upper journal bearing 162 and the lower journal bearing 164 can enable the internal pipe 130 to rotate relative to the swivel housing 110. In embodiments, each of the journal bearings 160 can be rigidly secured to the inner surface 116 of the swivel housing 110, and the internal pipe 130 can be slidably received through each of the journal bearings 160 so that the internal pipe 130 can rotate relative to the swivel housing 110. In embodiments, the journal bearings 160 can be slideable relative to the outer surface 132 of the internal pipe 130 and the inner surface 116 of the swivel housing 110. The journal bearings 160 can restrict axial movement of the cross BOP swivel joint 100 relative to the BOP stack 70. Axial movement of the cross BOP swivel joint 100 when the BOP stack 70 is activated can cause the cross BOP swivel joint 100 to accidently be pulled out of the BOP stack 70. This can lead to leakage of hydrocarbons to the atmosphere or to damaging the seals of the ram BOP 80.

Referring again to FIG. 5, the cross BOP swivel joint 100 can further include one or a plurality of central bearings 170. The central bearings 170 can be radially disposed between the outer surface 132 of the internal pipe 130 and the inner surface 116 of the cylindrical wall 112 of the swivel housing 110. The central bearings 170 may be disposed within the annular compartment 150 defined between the swivel housing 110 and the internal pipe 130. The central bearings 170 may be axially disposed between the upper journal bearing 162 and the lower journal bearing 164. The one or plurality of central bearings 170 can provide radial support to the swivel housing 110 that reduces deformation of the swivel housing 110 radially inward towards the internal pipe 130 when a BOP is engaged with the outer surface 114 of the swivel housing 110. The central bearings 170 can also provide further stability to rotation of the internal pipe 130 relative to the swivel housing 110.

The central bearings 170 can be any type of bearing operable to reduce or prevent deflection of the swivel housing 110 radially inward towards the internal pipe 130 while also allowing efficient rotation of the internal pipe 130 relative to the swivel housing 110. Examples of bearings suitable for the central bearings 170 can include but are not limited to ball bearings, roller bearings, thrust ball bearings, thrust roller bearings, other types of bearings, or combinations of these. In embodiments, journal bearings may not be suitable for use as the central bearings 170. Not intending to be bound by any particular theory, it is believed that the radial forces of the BOP against the swivel housing 110 would create increased friction in a journal bearing that would increase resistance to rotation of the internal pipe 130 relative to the swivel housing 110. In embodiments, the central bearings 170 can be ball bearings. The ball bearings can include an outer race secured to the inner surface 116 of the swivel housing 110, an inner race secured to the outer surface 132 of the internal pipe 130, and a plurality of rigid balls disposed between the inner race and the outer race. The ball bearing can reduce deformation of the swivel housing 110 radially inward towards the internal pipe 130 when a blowout preventer is engaged with the outer surface 114 of the swivel housing 110 while at the same time stabilizing rotation of the internal pipe 130 relative to the swivel housing 110.

As previously discussed, the central bearings 170 are axially disposed between the upper journal bearing 162 and the lower journal bearing 164. The swivel housing 110 may have an axial center B that refers to a point of the swivel housing that is axially halfway between the upper journal bearing 162 and the lower journal bearing 164. In other words, an axial length L of the swivel housing 110 is defined as the axial distance between the upper journal bearing 162 and the lower journal bearing 164, and the axial center B is the point where the distance from the axial center B to the upper journal bearing 162 is the same as the distance from the axial center B to the lower journal bearing 164. The central bearings 170 may be axially disposed close enough to the axial center B to reduce or prevent deflection of the swivel housing 110 radially inward towards the internal pipe 130. When the central bearings 170 are disposed too close to the journal bearings 160, the center part of the swivel housing 110 proximate the axial center B may not have sufficient radial support to prevent deflection of the swivel housing 110 from interfering with rotation of the internal pipe 130. In embodiments, each of the central bearings 170 can be axially disposed at a distance from the axial center B of the swivel housing 110 that is less than 40%, less than or equal to 35%, less than or equal to 30%, less than or equal to 25%, or even less than or equal to 20% of the axial length L between the upper journal bearing 162 and the lower journal bearing 164.

In embodiments, the cross BOP swivel joint 100 can include a plurality of central bearings 170 that are spaced apart from each other and distributed axially between the upper journal bearing 162 and the lower journal bearing 164. When the cross BOP swivel joint 100 includes a plurality of central bearings 170, each of the plurality of central bearings 170 can be axially positioned at a distance from the axial center B of the swivel housing 110 that is less than 40%, less than or equal to 35%, less than or equal to 30%, or even less than or equal to 25% of the axial length L between the upper journal bearing 162 and the lower journal bearing 164. Evenly distributing the central bearings 170 throughout the annular compartment 150 between the journal bearings 160 can further reduce or prevent deflection of the swivel housing 110 radially inward and can further stabilize rotation of the internal pipe 130 relative to the swivel housing 110.

Referring again to FIG. 5, the cross BOP swivel joint 100 can further include a plurality of seals 180 disposed radially between the inner surface 116 of the swivel housing 110 and the outer surface 132 of the internal pipe 130. The seals 180 can be disposed in an annular gap between the inner surface 116 of the swivel housing 110 and the outer surface 132 of the internal pipe 130. The seals 180 can seal the annular gap between the swivel housing 110 and the internal pipe 130 to restrict or prevent fluid flow through the annular gap and into the annular compartment 150. Thus, the seals 180 prevent fluid from the annulus of the wellbore 10 from bypassing the BOP by flowing through the gap between the internal pipe 130 and the swivel housing 110 of the cross BOP swivel joint 100. The seals 180 may fluidly isolate the annular compartment 150 between the swivel housing 110 and the internal pipe 130 from the wellbore annulus and from the atmosphere at the surface 12. The seals 180 may comprise a resilient material that allows the internal pipe 130 to rotate relative to the swivel housing 110 while preventing fluid flow between the swivel housing 110 and the internal pipe 130. In embodiments, the seals 180 can be gaskets, o-rings or other structures comprising the resilient materials. In embodiments, the seals 180 can include one or more mechanical seals. Other types of suitable commercially available seals are contemplated.

The plurality of seals 180 can include upper seals and lower seals. The upper seals can be disposed axially between the upper journal bearing 162 and the top end 120 of the swivel housing 110, such as axially in the upper restriction 124 of the swivel housing 110 and radially between the upper restriction 124 and the internal pipe 130. The lower seals can be disposed axially between the lower journal bearing 164 and the bottom end 122 of the swivel housing 110, such as axially in the lower restriction 126 of the swivel housing 110 and radially between the lower restriction 126 and the internal pipe 130. In embodiments, the cross BOP swivel joint 100 can include additional seals 180 axially disposed between the journal bearings 160. In embodiments, the seals 180 can include a plurality of internal seals disposed axially between the journal bearings 160. In embodiments, the internal seals can be disposed between at least one central bearing 170 and the upper journal bearing 162, between at least one central bearing 170 and the lower journal bearing 164, between two central bearings 170 or combinations of these.

Referring again to FIG. 5, the plurality of seals 180, in particular the internal seals, can divide the annular compartment 150 into a plurality of annular compartments that are fluidly isolated from one another. In embodiments, each of the annular compartments can be separated from one another by one of the central bearings 170 as well as by the seals 180. Each of the annular compartments can include a lubricant, such as a synthetic or natural oil, grease, or other lubricant. The lubricant may provide lubrication to the central bearings 170, the journal bearings 160, or both. The lubricant may further provide a hydrostatic barrier on the inside of the seals 180 to further resist penetration of drilling fluids and formation fluids through the seals and into the annular compartments 150.

The cross BOP swivel joint 100 can further include one or a plurality of ports 190 in the swivel housing 110. The ports 190 can extend radially through the swivel housing 110. The each of the ports 190 can be in fluid communication with at least one of the annular compartments 150 between the internal pipe 130 and the swivel housing 110. The ports 190 may enable lubricant materials to be dispensed into the annular compartments 150. Additionally, the ports 190 can further enable inspection of the annular compartments 150, measurement of pressure within each of the annular compartments 150, or both. For example, the ports 190 can enable sampling of the lubricants, which can be used to determine whether drilling fluids or formation fluids have penetrated through any of the seals 180. The ports 190 may enable other maintenance activities or measurements, such as temperature, pressure, or other property.

Figure 7:
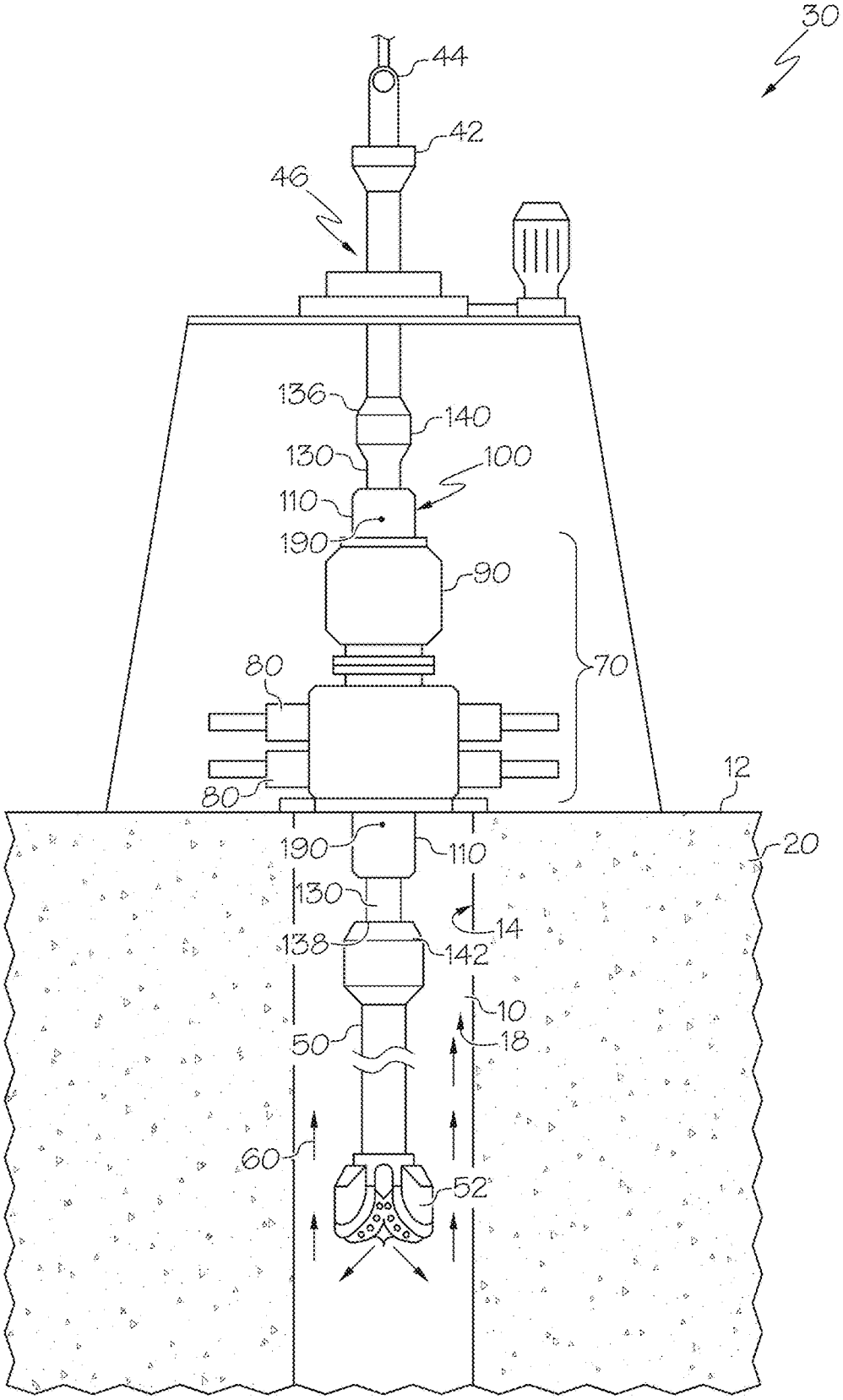
FIG. 7 schematically depicts a drilling apparatus having the cross BOP swivel joint of FIG. 5, according to one or more embodiments shown and described in this disclosure.

Referring now to FIG. 7, the cross BOP swivel joint 100 of the present disclosure can be incorporated into the drilling apparatus 30 for drilling the wellbore 10. The drilling apparatus 30 can include the drilling rig 40, a BOP stack 70 comprising at least one BOP, the cross BOP swivel joint 100, and the drill string 50 coupled to the lower end 138 of the internal pipe 130 of the cross BOP swivel joint 100. The cross BOP swivel joint 100 can be received through a central opening through the at least one BOP in the BOP stack 70. When the at least one BOP in the BOP stack 70 is activated, the BOP contacts the outer surface 114 of the swivel housing 110 of the cross BOP swivel joint 100. Cross BOP swivel joint 100 can include any of the features previously discussed in the present disclosure for the cross BOP swivel joint 100. As previously discussed, the BOP stack 70 can include one or a plurality of pipe-ram BOPS 80, one or a plurality of annular BOPs 90, or combinations of these. In embodiments, the BOP stack 70 may further include a blind ram BOP, a shear ram BOP, or other type of BOP. It is noted that blind ram BOPs and shear ram BOPs are generally not designed to interact or engage with the outer surface of the drill string 50. For instance, a blind ram BOP is generally designed to close the entirety of the wellbore when no drill string 50 is disposed in the wellbore 10, and a shear ram BOP is generally designed to sever the drill string 50 to completely seal the wellbore 10.

The drill string 50 can include a drill bit 52 secured to the downhole end of the drill string 50. The drill string 50 can further include a bottom hole assembly comprising the drill bit, underreamers, drill collars, and other downhole equipment. As previously discussed, the drilling rig 40 can include the drive system 46. The drive system 46 can be secured to the upper end 136 of the internal pipe 130 of the cross BOP swivel joint 100. The drive system 46 can be operable to rotate the drill string 50 through the internal pipe 130 connecting the drive system 46 to the drill string 50. The drive system 46 rotates the internal pipe 130 and drill string 50 relative to the wellbore wall 14. The drive system 46 can be a top drive system, a Kelly drive system, or other type of drive system. As previously discussed, the drilling rig 40 can further include the swivel 42 and the hoist system 44. In embodiments, the drive system 46 can be a top drive system, and the swivel 42 can be disposed between the drive system 46 and the cross BOP swivel joint 100 and can be secured to the upper end 136 of the internal pipe 130 and to the hoist system 44. In embodiments, the drive system 46 can be a Kelly drive system, and the swivel 42 can be disposed between a Kelly of the Kelly drive system and the hoist system 44. For a Kelly drive system, the Kelly of the Kelly drive system can be secured to the upper end 136 of the internal pipe 130 of the cross BOP swivel joint 100.

Figure 8:
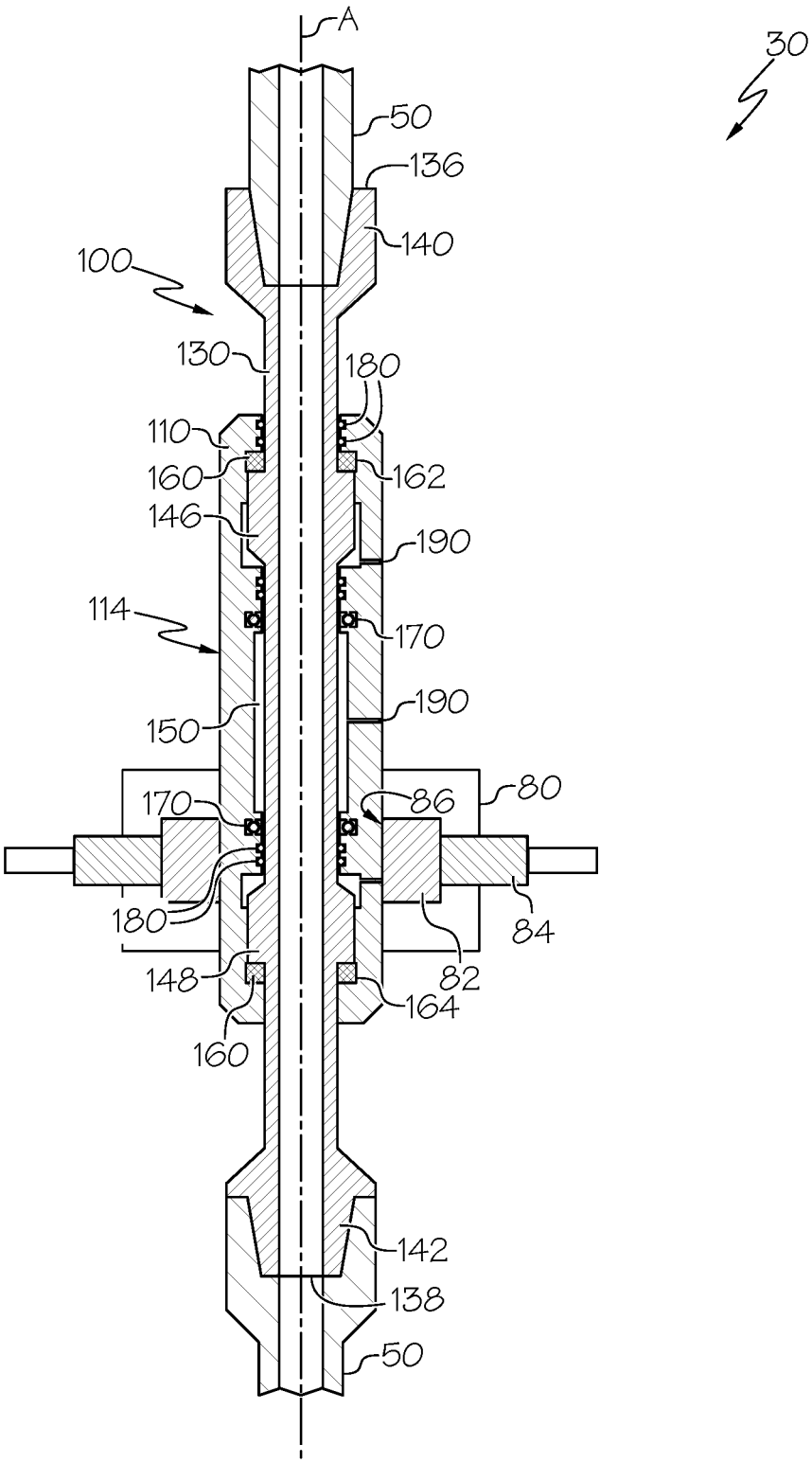
FIG. 8 schematically depicts a front cross-sectional view of the cross BOP swivel joint of FIG. 5 with a pipe ram blowout preventer engaged with an outer surface of the cross BOP swivel joint, according to one or more embodiments shown and described in this disclosure.

Referring now to FIGS. 7 and 8, operation of the cross BOP swivel joint 100 during a well control event will be discussed. During normal operation, the drill but 52 is operated in the wellbore 10 by rotating the drill string 50 relative to the wellbore wall 14 using the drive system 46. During normal operation, the swivel housing 110 and internal pipe 130 of the cross BOP swivel joint 100 both can rotate relative to the wellbore wall 14.

The drilling apparatus 30 can further include a plurality of instruments (not shown) coupled to various components of the drill string 50 or to the drilling apparatus 30. The instruments can be used to identify a condition of the wellbore 10 indicating the undesired flow of formation fluids from the subterranean formation 20 into the wellbore 10, such as resulting from formation kick or other upset condition. Undesired flow of formation fluids into the wellbore refers to the flow of formation fluids into the wellbore during drilling or completion of the wellbore and does not include purposeful production of hydrocarbons from the subterranean formation 20 after well completion. The conditions indicating flow of formation fluids into the wellbore 10 can include monitoring the pressure of the wellbore, the composition of the drilling fluids 60 returned to the surface 12, or other operating condition of the wellbore 10.

Identifying the undesired flow of formation fluids into the wellbore can initiate a well control event. Referring to FIG. 8, upon identifying a condition indicating the undesired flow of formation fluids into the wellbore 10, initiating the well control event can include actuating one or more of the pipe-ram BOPs 80, annular BOPs 90 (FIG. 7), or both of the BOP stack 70 to engage with the outer surface 114 of the swivel housing 110. Engagement of the pipe-ram BOP 80, annular BOP 90, or both, seals off the annulus 18 of the wellbore 10, which prevents the flow of drilling fluids 60, formation fluids, or both through the annulus 18 towards the surface 12. Engagement of the pipe-ram BOP 80, the annular BOP 90, or both results in contact of the engagement surface 86 of the pipe-ram BOP 80 or sealing member 94 of the annular BOP 90 with the outer surface 114 of swivel housing 110, which reduces or prevents the rotation of the swivel housing 110 relative to the BOP stack 70 and the wellbore wall 14.

The journal bearings 160 and central bearings 170 of the cross BOP swivel joint 100 allow continued rotation of the internal pipe 130 of the cross BOP swivel joint 100 relative to the BOP stack 70 when the BOPs are engaged with the outer surface 114 of the swivel housing 110. Additionally, the central bearings 170 can reduce or prevent deflection of the swivel housing 110 radially inward towards the internal pipe 130 caused by engagement of the BOPs. Thus, during the well control event in which the BOPs are engaged with the swivel housing 110, the drive system 46 can still be operated to rotate the internal pipe 130 of the cross BOP swivel joint 100 and the drill string 50 coupled to the lower end 138 of the internal pipe 130.

The cause of the flow of wellbore fluids into the wellbore can be remediated, such as by adjusting the pressure of drilling fluid in the wellbore. Following remediation, the BOPs in the BOP stack 70 can be actuated to disengage the BOPs from the outer surface 114 of the swivel housing 110 to allow the flow of drilling fluids through the annulus 18 of the wellbore 10 back to the surface 12.

In embodiments, the BOP stack 70 can include at least one annular BOP 90 and at least one pipe ram BOP 80 disposed downhole from the annular BOP 90, and the cross BOP swivel joint 100 can have a swivel housing 110 that extends across the annular BOP 90 but not across the pipe ram BOP 80. In this configuration, the annular BOP 90, when engaged, contacts and seals around the outer surface 114 of the swivel housing 110, and the ram BOP 80 closes on the drill string 50 downhole of the cross BOP swivel joint 100. During operation, the annular BOP 90 can be engaged in response to a well control event. When engaged, the annular BOP 90 closes around the outer surface 114 of the swivel housing 110 to close off the annulus 18. The well control event can then be remediated while the drill string 50 is rotated to prevent differential sticking of the drill string 50 in the wellbore 10. Once the well control even is remediated, the annular BOP 90 can be disengaged to resume normal operation.

In case of a leak forming in the cross-BOP swivel joint 100 or between the cross BOP swivel joint 100 and the annular BOP 90, the pipe ram BOP 80 can be engaged at a backup. When engaged, the pipe ram BOP 80 engages with the drill string 50 downhole from the cross BOP swivel joint 100 to re-seal the annulus 18. However, engagement of the pipe ram BOP 80 with the drill string 50 will then prevent rotation of the drill string 50 during the well control event.

The cross BOP swivel joint 100 of the present disclosure can be employed in methods of drilling a wellbore in a subterranean formation. Referring again to FIG. 7, the methods can include operating the drill string 50 in a wellbore 10, the drill string 50 comprising the cross BOP swivel joint 100 of the present disclosure and at least a drill bit 52. The methods can further include sealing the annulus 18 defined between the drill string 50 and the wellbore wall 14 of the wellbore 10. Sealing the annulus 18 can include operating at least one BOP disposed at the surface 12 of the wellbore 10. When actuated, the BOP engages with the outer surface 114 of the swivel housing 110 of the cross BOP swivel joint 100. In embodiments, the BOP can be a pipe ram BOP 80, an annular BOP 90, or both. Engagement of the BOP with the outer surface 114 of the swivel housing 110 can maintain the swivel housing 110 in a static position (not rotating). The methods can further include, after sealing the annulus 18 with the at least one BOP, rotating the drill string 50 in the wellbore 10. Rotating the drill string 50 can cause the internal pipe 130 of the cross BOP swivel joint 100 to rotate relative to the swivel housing 110. In embodiments, the at least one central bearing 170 can reduce deflection of the swivel housing 110 radially inward towards the internal pipe 130 when the BOP is engaged with the outer surface 114 of the swivel housing 110.

In embodiments, the methods can further include identifying a condition of the wellbore 10 indicative of wellbore kick or possible blowout, and in response to the condition indicative of the wellbore kick or possible blowout, operating the at least one BOP to seal the annulus 18 of the wellbore 10. In embodiments, the methods can further include correcting or compensating for the conditions of the wellbore indicative of the formation kick or possible blowout. Following correction of the conditions indicative of the well control event, re-opening the annulus 18 by disengaging the BOPs from the swivel housing 110.

It is noted that one or more of the following claims utilize the terms "where," "wherein," or "in which" as transitional phrases. For the purposes of defining the present technology, it is noted that these terms are introduced in the claims as an open-ended transitional phrase that are used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A cross BOP swivel joint for crossing a blowout preventer (BOP) of a drilling apparatus, the cross BOP swivel joint comprising:

a swivel housing comprising a hollow cylindrical wall having a top end, a bottom end, an inner surface that defines an inner cavity extending axially through the swivel housing, and an outer surface;

an internal pipe received through the inner cavity of the swivel housing, the internal pipe comprising an upper loading shoulder proximate the top end of the swivel housing and a lower loading shoulder proximate the bottom end of the swivel housing;

an upper journal bearing, a lower journal bearing, and at least one central bearing, each of which is radially disposed between an outer surface of the internal pipe and the inner surface of the cylindrical wall of the swivel housing, where:

the upper journal bearing is axially disposed between the upper loading shoulder of the internal pipe and the top end of the swivel housing;

the lower journal bearing is axially disposed between the lower loading shoulder of the internal pipe and the bottom end of the swivel housing;

the upper journal bearing and the lower journal bearing allow the internal pipe to rotate relative to the swivel housing;

the at least one central bearing is axially disposed between the upper journal bearing and the lower journal bearing;

the outer surface of the swivel housing contacts the blowout preventer when the blowout preventer is engaged with the cross BOP swivel joint; and the at least one central bearing provides radial support to the swivel housing that reduces deformation of the swivel housing radially inward towards the internal pipe when the blowout preventer is engaged with the outer surface of the swivel housing.

2. The cross BOP swivel joint of claim 1, comprising a plurality of central bearings spaced apart from each other and distributed axially between the upper journal bearing and the lower journal bearing.

3. The cross BOP swivel joint of claim 1, where:

an axial center of the swivel housing is a point that is axially disposed halfway between the upper journal bearing and the lower journal bearing;

the at least one central bearing is axially positioned at a distance from the axial center of the swivel housing that is less than 40% of an axial length between the upper journal bearing and the lower journal bearing.

4. The cross BOP swivel joint of claim 3, comprising a plurality of central bearings, where each of the plurality of central bearings are axially positioned at a distance from the axial center of the swivel housing that is less than 40% of the axial length between the upper journal bearing and the lower journal bearing.

5. The cross BOP swivel joint of claim 4, where the plurality of central bearings are spaced apart and evenly distributed axially between the upper journal bearing and the lower journal bearing.

6. The cross BOP swivel joint of claim 1, where the at least one central bearing comprises at least one ball bearing.

7. The cross BOP swivel joint of claim 6, where the at least one ball bearing comprises an outer race secured to the inner surface of the swivel housing, an inner race secured to the outer surface of the internal pipe, and a plurality of rigid balls disposed between the inner race and the outer race, where the at least one ball bearing stabilizes rotation of the internal pipe relative to the swivel housing and reduces deformation of the swivel housing radially inward towards the internal pipe when the blowout preventer is engaged with the outer surface of the swivel housing.

8. The cross BOP swivel joint of claim 1, where the upper journal bearing and the lower journal bearing are rigidly coupled to the swivel housing and slidably engaged with the internal pipe to allow the internal pipe to rotate relative to the journal bearing and swivel housing.

9. The cross BOP swivel joint of claim 1, further comprising a plurality of seals disposed radially between the outer surface of the internal pipe and the inner surface of the cylindrical wall of the swivel housing, where the seals restrict fluid flow through an annular gap between the internal pipe and the inner surface of the cylindrical wall of the swivel housing.

10. The cross BOP swivel joint of claim 9, where the plurality of seals comprise a plurality of upper seals disposed axially between the upper journal bearing and the top end of the swivel housing and a plurality of lower seals disposed axially between the lower journal bearing and the bottom end of the swivel housing.

11. The cross BOP swivel joint of claim 9, where the plurality of seals comprise a plurality of internal seals disposed axially between the at least one central bearing and the upper journal bearing and between the at least one central bearing and the lower journal bearing.

12. The cross BOP swivel joint of claim 9, where:

an annular compartment is defined radially between the inner surface of the swivel housing and the outer surface of the internal pipe;

one or more internal seals are radially disposed in the annular compartment; and the one or more internal seals fluidly separate the annular compartment into a plurality of annular compartments.

13. The swivel housing of claim 12, further comprising a lubricant disposed in the plurality of annular compartments.

14. The swivel housing of claim 12, further comprising at least one port in the swivel housing, wherein the at least one port extends radially through the swivel housing and the at least one port is in fluid communication with the annular compartment.

15. The cross BOP swivel joint of claim 1, where the internal pipe extends axially above the top end and below the bottom end of the swivel housing.

16. The cross BOP swivel joint of claim 15, where the internal pipe further comprises a box connection at an upper end of the internal pipe and a pin connection at a lower end of the internal pipe.

17. A drilling apparatus for drilling a wellbore, the drilling apparatus comprising:

at least one blowout preventer;

the cross BOP swivel joint of claim 1; and a drill string coupled to a lower end of the internal pipe of the cross BOP swivel joint, where:

the cross BOP swivel joint is received through an opening in the at least one blowout preventer; and when the at least one blowout preventer is activated, the at least one blowout preventer contacts the outer surface of the swivel housing of the cross BOP swivel joint.

18. The drilling apparatus of claim 17, further comprising a drive system coupled to an upper end of the internal pipe of the cross BOP swivel joint, the drive system operable to rotate the drill string through the internal pipe connecting the drive system to the drill string, where the drill string is rotated relative to the wellbore.

19. The drilling apparatus of claim 17, where the at least one blowout preventer is a pipe ram blowout preventer, an annular blowout preventer, of a combination of both.

20. A method of drilling a subterranean formation, the method comprising:

operating a drill string in a wellbore, the drill string comprising the cross BOP swivel joint of claim 1;

sealing an annulus between the drill string and a wellbore wall of the wellbore by operating at least one blowout preventer disposed at a surface of the wellbore, where the blowout preventer engages with the outer surface of the swivel housing of the cross BOP swivel joint; and after sealing the annulus with the at least one blowout preventer, rotating the drill string in the wellbore, where:

engagement of the blowout preventer with the outer surface of the swivel housing maintains the swivel housing in a static position;

rotating the drill string causes the internal pipe of the cross BOP swivel joint to rotate relative to the swivel housing; and the at least one central bearing reduces deflection of the swivel housing radially inward towards the internal pipe.

* * * * *